US006568802B2

(12) United States Patent
Galan et al.

(10) Patent No.: US 6,568,802 B2
(45) **Date of Patent: *May 27, 2003**

(54) INK FEEDING CIRCUIT DEVICE FOR RASTER DRAWING MACHINES

(75) Inventors: D. Mario Andrada Galan, Madrid (ES); Jose Ramon Perez Gonzalez, Madrid (ES)

(73) Assignee: Investronica Sistemas S.A., Madrid (ES)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/362,532

(22) Filed: Jul. 28, 1999

(65) Prior Publication Data

US 2002/0001025 A1 Jan. 3, 2002

(30) Foreign Application Priority Data

Aug. 7, 1998 (ES) ..... 9802121 U

(51) Int. Cl.[7] ..... B41J 2/17

(52) U.S. Cl. ..... 347/94

(58) Field of Search ..... 347/94, 93, 104

(56) References Cited

U.S. PATENT DOCUMENTS

| | | | | | |
|---|---|---|---|---|---|
| 3,083,689 | A | * | 4/1963 | Hegener | 346/140.1 |
| 4,347,524 | A | * | 8/1982 | Engel et al. | 347/94 |
| 4,422,084 | A | * | 12/1983 | Saito | 347/7 |
| 4,739,415 | A | * | 4/1988 | Toyono et al. | 347/40 X |
| 5,030,973 | A | * | 7/1991 | Nonoyama et al. | 347/14 |
| 6,120,143 | A | * | 9/2000 | Narushima et al. | 347/93 |

FOREIGN PATENT DOCUMENTS

| | | | | |
|---|---|---|---|---|
| DE | 3204661 A1 | * | 8/1983 | 347/85 |

* cited by examiner

*Primary Examiner*—Hai Pham
(74) *Attorney, Agent, or Firm*—William J. Sapone; Coleman Sudol Sapone, P.C.

(57) ABSTRACT

Ink feeding circuit device for a raster drawing machine comprising an ink jet printing head 1 moving in x and y direction over the drawing plane 20 of the drawing machine 10 and comprising a feed circuit including an ink supply reservoir 2 connected with the ink jet printing head 1 by a conduit 31 which communicates with a gas damper 9.

1 Claim, 3 Drawing Sheets

INK FEEDING CIRCUIT DEVICE FOR RASTER DRAWING MACHINES

FIELD OF APPLICATION

The object of this invention is a damping device that would allow the ink jet printing head device to be released from the negative influences caused by positive and negative pressure forces that are due to the effect of the inertial forces of the fluid that feed the printing head, together with the vibrations arising from the operation of the drawing machine. The device is applicable to any drawing or printing machine that uses ink jet technology.

STATE OF THE ART

The raster type drawing machines that use ink jet printing heads are already well-known, but these machines (plotters) that operate with considerable printing head travelling distances, such as that described in patent ES-9701193, work under difficult speed and acceleration conditions in order to achieve high productivity rates. Normally, those movements are made up of acceleration, constant speed and deceleration stages. These speed changes produce pressure waves on the ink level subjected to the movement that produce printing head faulty operation situations. In order to reduce the mobile mass to the miminum required, the printing head is fed from an ink deposit as reservoir located in a remote location, of a size large enough to allow considerable drawing machine autonomy, being this the cause of oscillations that may be even greater than the working margin of the printing head, preventing its proper operation.

SUMMARY OF THE INVENTION

This invention refers to a damping device for pressure changes in the printing head ink feeding circuit. The device is made up of conduits fitted with branching conduits that house a gas that dampens the pressure wave, whereas the ink is displaced through the main conduit.

DETAILED DESCRIPTION

Figure 1:
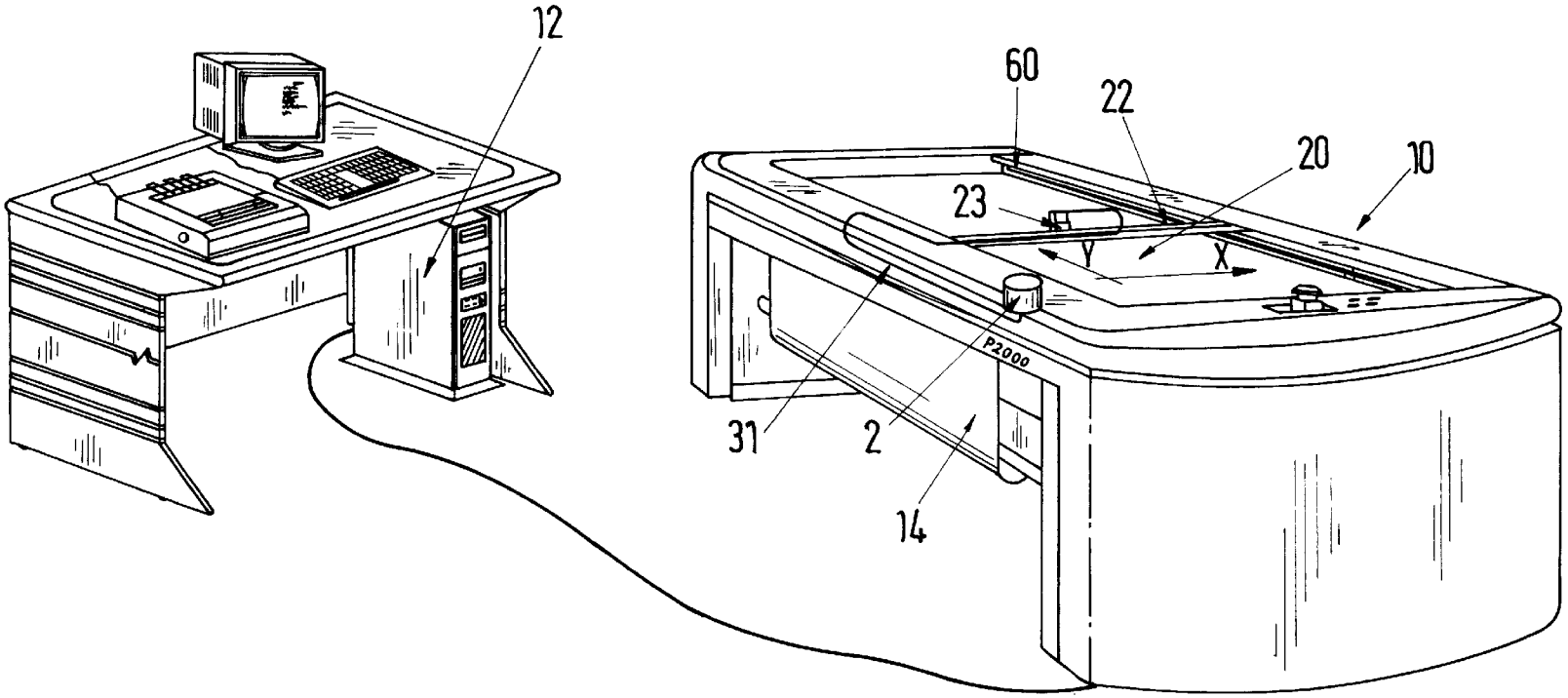
FIG. 1 Perspective view of the drawing machine assembly.

The device that is the subject of this invention is applied upon a raster type drawing machine 10 controlled by a computer 12 as shown in FIG. 1. The printing head support mechanism 23 of these drawing machines is capable of moving in two directions x and y on the plane 20, over which the drawing paper 14 is spread out.

The ink jet printing head 1 (see FIG. 3) is located on the printing head support mechanism 23 whereas the ink supply 3 supply reservoir 2 is located in a stationary area of the drawing machine located away from the ink jet printing head. The section of the conduit 31 located between the ink reservoir 2 and the printing head 1, located on the printing head support mechanism 23 normally holds a significant amount of ink, indicated by 4, in FIG. 3 and the conduit 31 is subjected to the movement of the printing head support mechanism 23 fitted on the printing head bridging bar 22 travelling on guides 60 of the drawing machine 10.

The operation of the ink jet printing head 1 is based on the application of electrical impulses on the walls that make up the delivery channels of the ink jet printing head—see ES 9701193, FIGS. 16 and 17—manufactured using piezoelectric material, whereas the walls 4 undergo deformation producing pressure that pushes out a drop of ink previously contained therein. The ink jet printing head 1 requires the ink level 5 within the ink feeding reservoir 2 to be below the level 6 of the lower nozzle—distance H—, i. e., operates under a negative pressure of some milibars.

Figure 2:
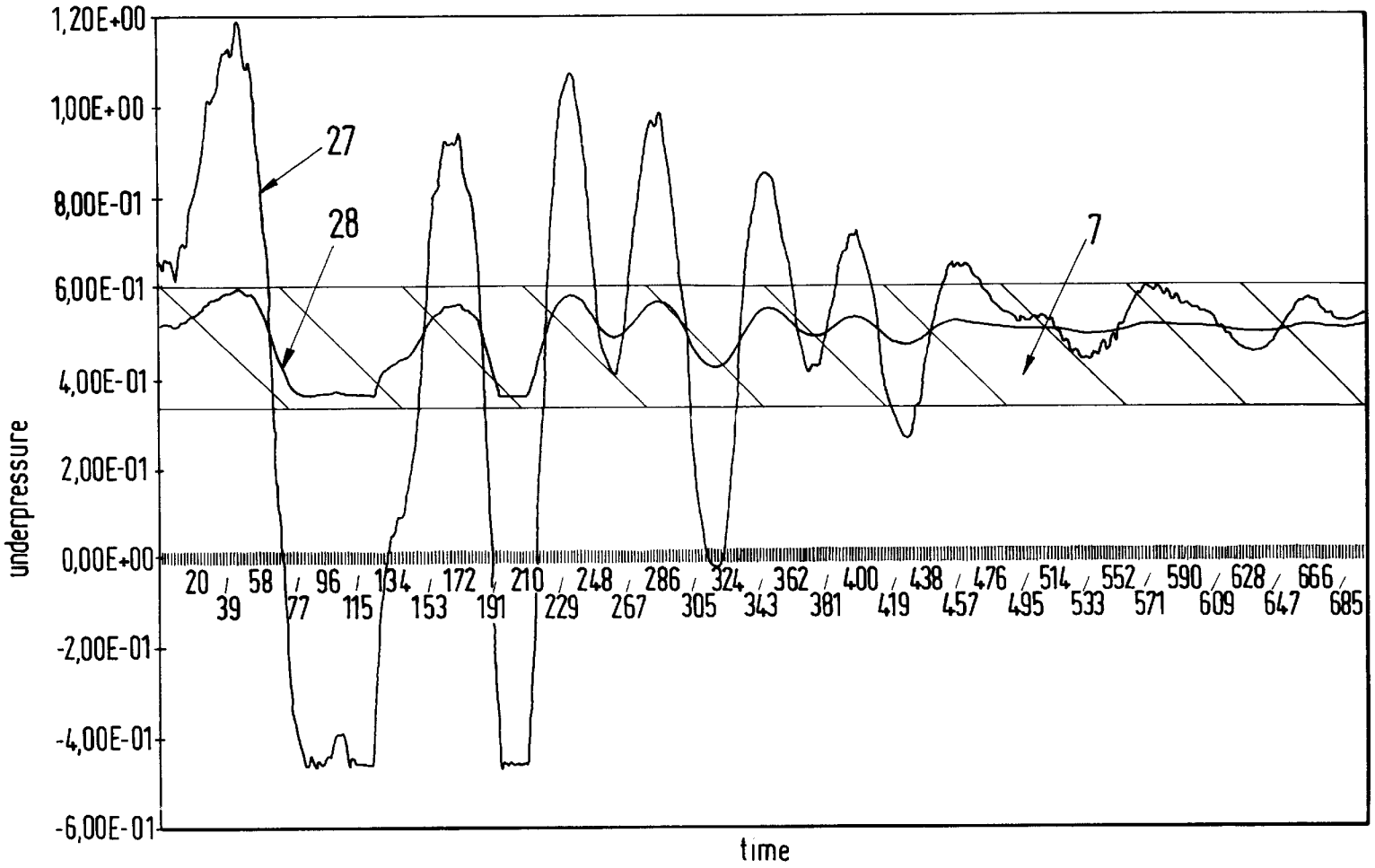
FIG. 2 Negative pressure—time graphic.

The pressure waves produced on the ink level 4 by the acceleration or deceleration forces generate a pressure force 27, FIG. 2, at the inlet to the ink jet printing head 1, as shown in the negative pressure—time graphic in FIG. 2. On this graphic it would be possible to appreciate the stable admissible area 7 of the ink jet printing head 1. Should a triggering command be generated, i. e., an electrical pulse, when the ink jet printing head 1 is subject to a pressure force 27 outside its admissible area 7, this would then cause a printing failure, which would consist of the absence of an ink drop or a defective ink triggering action.

Figure 3:
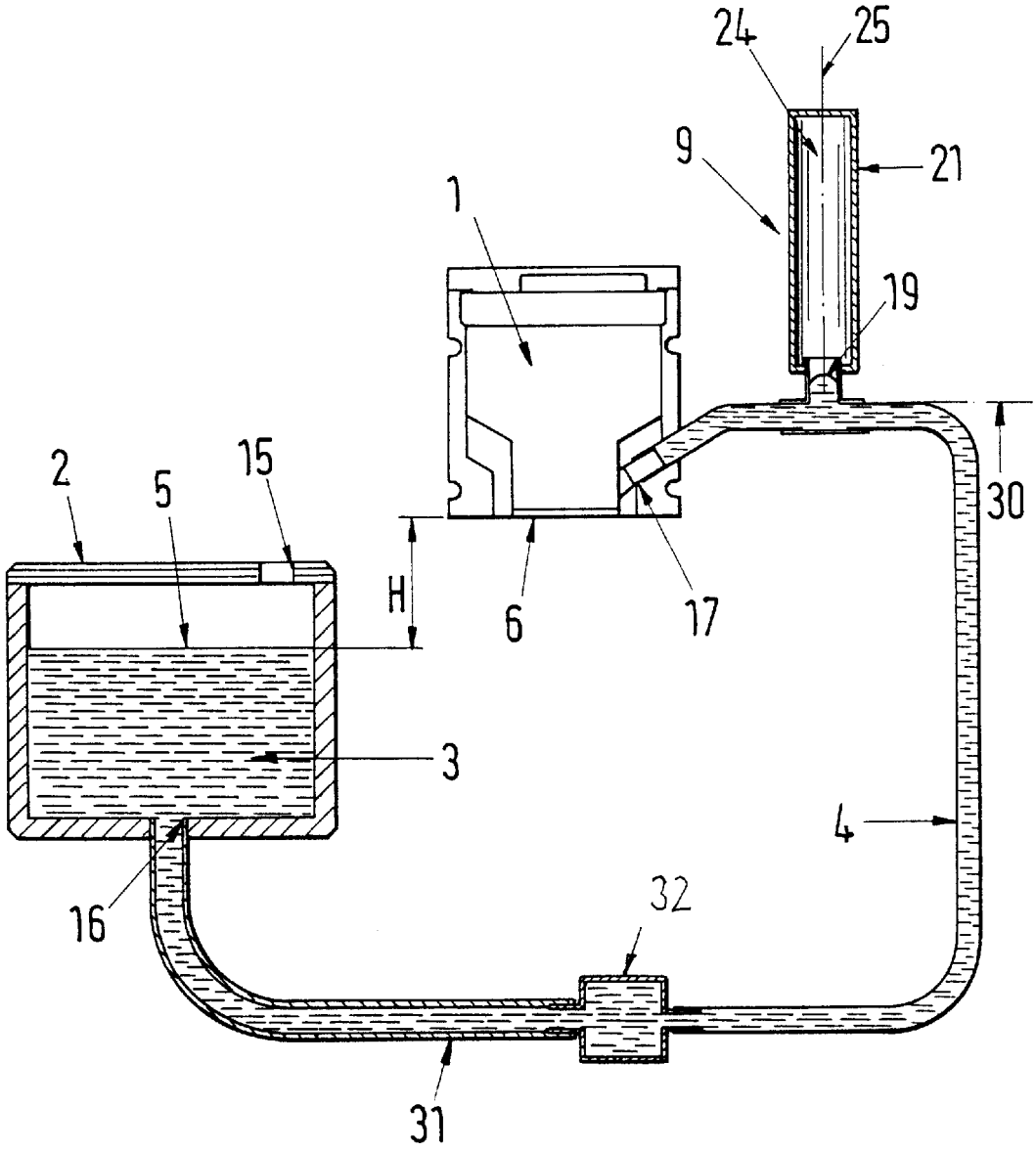
FIG. 3 Schematic drawing of the feeding circuit.

The ink feeding circuit incorporates a labyrinth filter 32 to clean the ink and to reduce speed, and further a gas damper 9 so that the energy associated to the pressure wave 27 is employed to compress the gas that is housed inside the damping chamber 24. FIG. 3 depicts the ink jet printing head 1 ink feeding circuit and the constructional shape of the damper. The ink feeding circuit comprises the reservoir 2 fitted with an opening 15 to communicate with atmosphere and a lower opening 16 through which the ink 3 flows into the circuit 31. The ink is driven to the ink jet printing head 1 through the generally flexible conduit 31 that at its end nearer the ink jet printing head 1 incorporates a gas damper The gas damper 9 is made up of a gas filled pipe 21 and the ink surface 19. The space taken up by the gas constitutes the damping chamber 24.

The gas damper is oriented using the pipe 21 depending upon the vertical direction 24 and above the level 30 of the ink conduit 31 so that the gas always tends to remain within the previously described pipe, both because of its lower density and because of the resistance to change caused by the surface tension on the meniscus formed on the surface 19 between the liquid fluid 4 in the conduit and gas stages. The gas may be air when oil based ink is used.

The damping chamber 14 must be sized so that its volume is enough to reduce the pressure wave 27, FIG. 2, down to a value admissible to the ink jet printing head 1 so as to generate a minimum bouncing motion. This reduction is fundamentally an inverse function of the square root of the gas value and of the speed of the pressure wave. The device shown generates a certain bouncing motion produced by the new expansion of the gas, although it already features much lower pressure values 28, FIG. 2, as may be observed in FIG. 2, and they do not interfere with the operation of the ink jet printing head 1. The device is placed near the ink jet printing head so as to increase its effectiveness.

What is claimed is:

1. An ink feeding circuit device for a raster drawing machine comprising an ink jet printing head (1) supported by a head bridge bar (22) traveling on guides of the drawing machine (10), the ink jet printing head (1) moveable in an x and y direction over a drawing plane (20) of the drawing machine, drawing paper (14) supportable on the drawing plane, a feed circuit having a stationary ink supply reservoir (2) connected with the movable ink jet printing head (1) by a conduit (31), and, a gas damper (9) which is in fluid communication with the conduit, the gas damper being a gas filled pipe, the gas remaining in the pipe, the pipe oriented in a vertical direction (25) above the conduit, and above the ink therein, and being located near the ink jet printing head, and movable therewith, a meniscus being formable between the ink in the conduit and the gas in the damper, to form a seal therebetween, the printing head located above an ink level (5) inside the supply reservoir (2) such that the printing head is operated under negative pressure.

* * * * *